US010815737B1

(12) United States Patent
Buck et al.

(10) Patent No.: US 10,815,737 B1
(45) Date of Patent: Oct. 27, 2020

(54) TOOL JOINT CLAMP

(71) Applicant: M & M Oil Tools, LLC, Breaux Bridge, LA (US)

(72) Inventors: David A. Buck, Arnaudville, LA (US); Andy Paul Todd, Lafayette, LA (US)

(73) Assignee: M & M Oil Tools, LLC, Breaux Bridge, LA (US)

( * ) Notice: Subject to any disclaimer, the term of this patent is extended or adjusted under 35 U.S.C. 154(b) by 50 days.

(21) Appl. No.: 16/351,071

(22) Filed: Mar. 12, 2019

Related U.S. Application Data

(60) Provisional application No. 62/653,173, filed on Apr. 5, 2018, provisional application No. 62/642,329, filed on Mar. 13, 2018.

(51) Int. Cl.
*E21B 17/046* (2006.01)
*E21B 19/16* (2006.01)
*E21B 17/02* (2006.01)

(52) U.S. Cl.
CPC ..... *E21B 17/046* (2013.01)

(58) Field of Classification Search
CPC ..... E21B 19/16; E21B 17/042; E21B 17/043; E21B 17/046; E21B 17/03; E21B 17/02; E21B 19/166; E21B 3/02; F16D 1/02
See application file for complete search history.

(56) References Cited

U.S. PATENT DOCUMENTS

| | | | | |
|---|---|---|---|---|
| 2,668,689 | A * | 2/1954 | Cormany | E21B 19/16 81/57.16 |
| 2,905,998 | A * | 9/1959 | Acker, Jr. | E21B 3/02 188/67 |
| 7,419,012 | B2 * | 9/2008 | Lynch | E21B 19/16 173/152 |
| 7,779,922 | B1 * | 8/2010 | Harris | E21B 19/16 166/379 |
| 10,544,631 | B2 * | 1/2020 | Reinecke | E21B 17/043 |
| 2007/0074874 | A1 * | 4/2007 | Richardson | E21B 17/06 166/379 |
| 2008/0238095 | A1 * | 10/2008 | Yater | E21B 21/02 285/333 |

OTHER PUBLICATIONS

Drawing of "Clamp assembly" in public use in the United States prior to Mar. 2018.

* cited by examiner

*Primary Examiner* — Kipp C Wallace
(74) *Attorney, Agent, or Firm* — Jones Walker LLP

(57) ABSTRACT

A tool joint clamp which includes a clamp assembly and a stop ring. The clamp assembly has at least two die carriers, with each die carrier having a translating and pivoting link between the die carriers such that the die carriers may move toward and away from a centerline of the clamp assembly. The stop ring includes a ring body having a central aperture forming an internal sidewall, with at least a portion of the internal sidewall having splines. A cam surface and cam follower are positioned between the clamp assembly and the stop ring, with the cam surface and cam follower configured to urge the die carriers toward the clamp assembly's centerline when relative torque is applied between the clamp assembly and the stop ring.

20 Claims, 5 Drawing Sheets

TOOL JOINT CLAMP

CROSS REFERENCE TO RELATED APPLICATIONS

This application claims the benefit under 35 USC 119(e) of U.S. Provisional Application No. 62/653,173 filed on Apr. 5, 2018 and U.S. Provisional Application No. 62/642,329 filed on Mar. 13, 2018, both of which are incorporated by reference herein in their entirety.

BACKGROUND OF INVENTION

The present invention relates to methods and apparatuses used to maintain and protect the integrity of threaded connections, particularly threaded connections between tubular members used in the oil and gas industry.

Ensuring that threaded connections are made up to a proper torque value and then maintained at that torque value is often critical for connecting many different types of tubular members used in the oil and gas industry. Using a drilling rig employing a top drive as one example, the top drive is equipped with a quill and various other tubular members to be rotated are connected to the quill. One common device or tool connected to the pin threads of the quill is a mud saver valve, which is made up with the quill to a predetermined torque value. A further series of tubulars are connected below the mud save valve, including those tubulars being inserted into the wellbore (e.g., drill pipe). This series of tubulars can be referred to collectively as the tubular string. Because the tubular string in the wellbore typically has certain resistance to rotation caused by friction and other forces, torque imparted by the top drive and quill to the other elements of the tubular string will have a tendency impart torque to the connections between tubulars, potentially over-torquing or under-torquing connections, depending on the direction of rotation.

Again using the quill and mud saver valve connection as an example, if this connection becomes over-torqued, it may damage the component threads and/or make the routine breaking apart of the connection excessively difficult. When connections cannot be readily broken, operators may be force to employ expedients such as heating the connection to loosen it. These expedients are problematic for a number of reasons and therefore, it is highly desirable to avoid over-torquing of the connections from the outset. The prior art has developed a class of devices to address this problem, often referred to as "joint clamps." The prior art joint clamps frequently consist of upper and lower clamp assemblies which may be joined in a manner to prevent relative rotation between the clamp assemblies. After the tubular connection has been made up to the desired torque value, the upper clamp assembly grips the upper tubular just above the connection point and the lower clamp assembly grips the lower tubular just below the connection point. Because the clamp assemblies are fixed against relative rotation, torque applied to the upper tubular is not transferred to the threads of the connection (assuming no slippage of the clamp assemblies), but rather to the flanges of the tubulars engaged by the clamp assemblies, thus preventing over-tightening or loosening of the connection. However, as suggested, the effectiveness of the joint clamps is largely dependent on the ability of clamp assemblies to resist slippage of the tubulars under the very considerable torque loads exerted by the top drive. Devices and methods for reducing or avoiding such slippage can provide an important advance in the art.

SUMMARY OF SELECTED EMBODIMENTS OF INVENTION

One embodiment of the present invention is a tool joint clamp which includes a clamp assembly and a stop ring. The clamp assembly has at least two die carriers, with each die carrier having a translating and pivoting link between the die carriers such that the die carriers may move toward and away from a centerline of the clamp assembly. The stop ring includes a ring body having a central aperture forming an internal sidewall, with at least a portion of the internal sidewall having splines. A cam surface and cam follower are positioned between the clamp assembly and the stop ring, with the cam surface and cam follower configured to urge the die carriers toward the clamp assembly's centerline when relative torque is applied between the clamp assembly and the stop ring.

Another embodiment of the invention is a method of reinforcing a tubular connection with a joint clamp. The method includes positioning a stop ring on a second tubular having external splines. The stop ring includes a ring body having a central aperture forming an internal sidewall, at least a portion of the internal sidewall having internal splines, and where the internal splines of the stop ring engage the external splines of the second tubular. A clamp assembly is positioned on a first tubular. The clamp assembly includes at least two die carriers, each die carrier having a translating and pivoting link between the die carriers such that the die carriers may move toward and away from a centerline of the clamp assembly. The first and second tubular members are threaded together, and the clamp assembly is engaged with the stop ring such that a cam surface and cam follower are positioned between the clamp assembly and the stop ring. The cam surface and cam follower are configured to cause the die carriers to impart an increased radial force on the first tubular when relative torque is applied between the clamp assembly and the stop ring. Then the clamp assembly is closed such that the die carriers engage the first tubular with an initial radial force.

DETAILED DESCRIPTION OF SELECTED EMBODIMENTS

Figure 2:
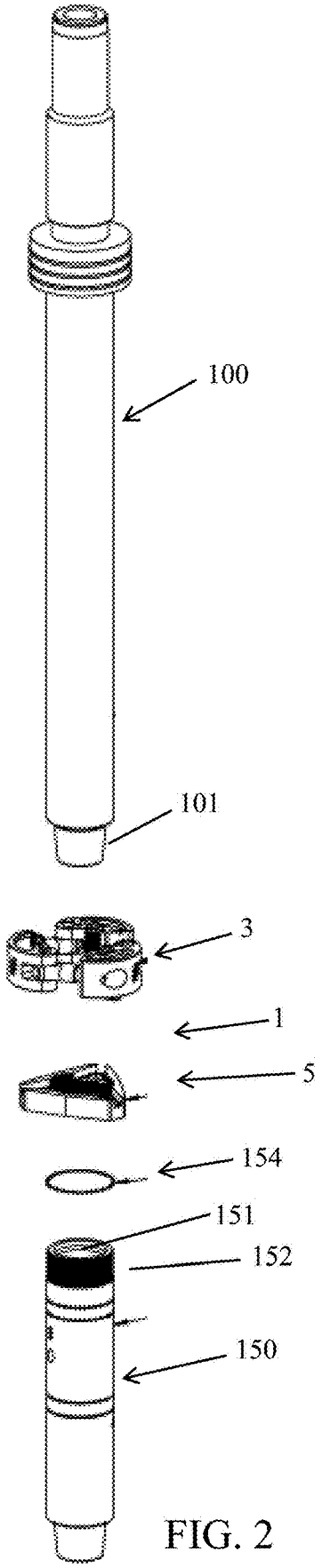
FIG. 2 is an exploded view of the tool joint clamp and tubulars of FIG. 1.
Figure 1:
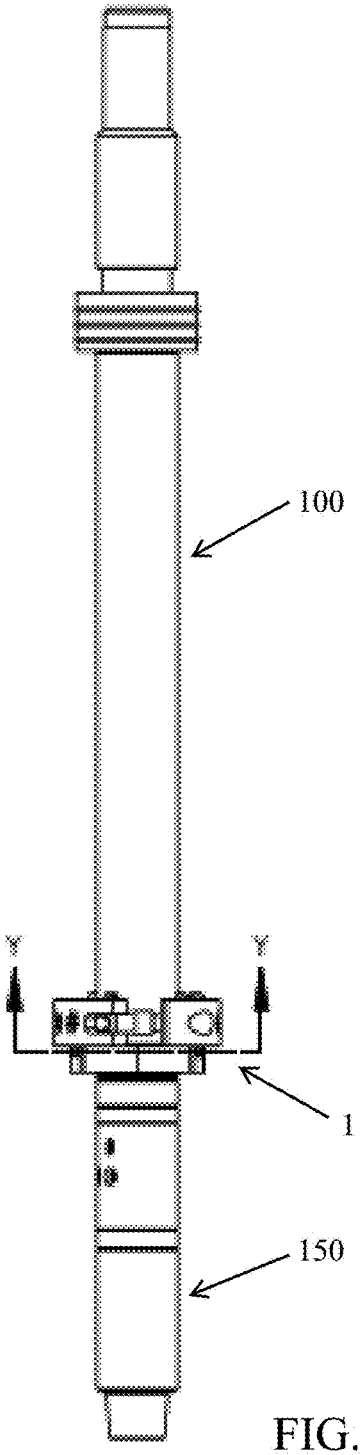
FIG. 1 is an assembled view one embodiment of the tool joint clamp and two tubular members to be engaged.

FIG. 1 illustrates one embodiment of the present invention, tool joint clamp 1, positioned over two tubular members 100 and 150, while FIG. 2 is an exploded view of the FIG. 1 embodiment. In the illustrated example, the first tubular member is a conventional top drive quill 100 while the second tubular member is a mud-saver valve body 150. However, the tubular connection to which the tool joint clamp may be applied could be a connection between many other types of tubular members employed in oil and gas well operations. Reference to a "first" tubular member and a "second" tubular member is intended to convey application of the tool joint camp 1 to all types of tubular members which are joined by a threaded connection (including those outside the oil and gas industry). As described in more detail below, the second tubular (e.g., a valve body) will typically have a series of external splines 152 formed at the tubular end having box threads 151. Of course, there could also be instances of the external splines being on the end of the tubular just above the pin threads.

Figure 5:
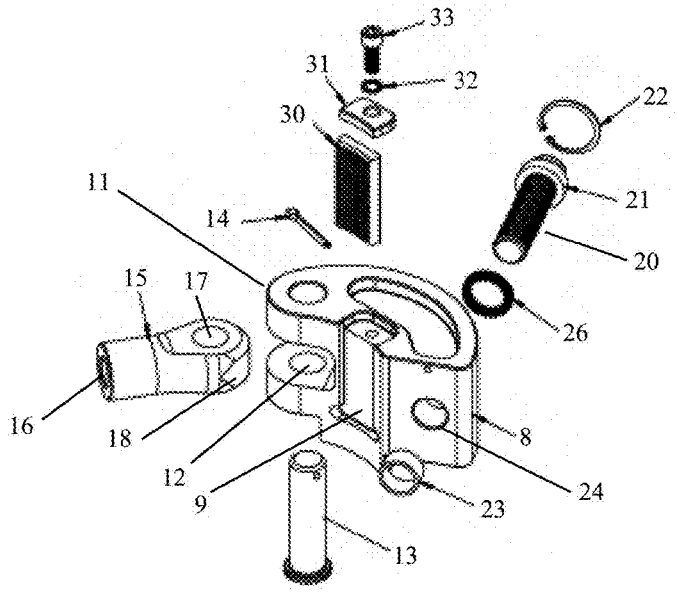
FIG. 5 is an exploded view of the FIG. 4 die carrier.
Figure 4:
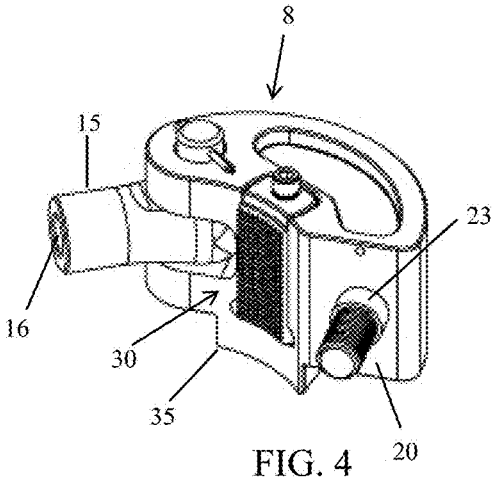
FIG. 4 is an assembled view of one of the die carriers seen in FIG. 3.
Figure 3:
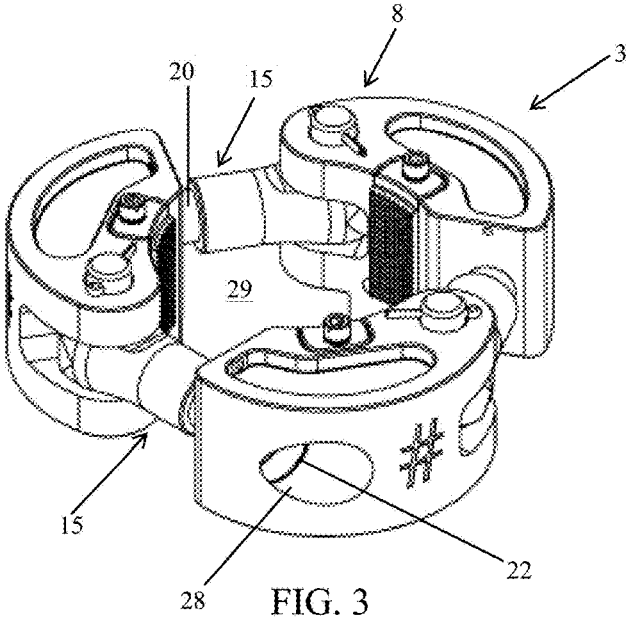
FIG. 3 is a perspective view of one embodiment of a clamp assembly formed by multiple die carriers.

In its most general form, the tool joint clamp 1 is constructed of the clamp assembly 3 and the stop ring 5. FIGS. 3 to 5 illustrate one embodiment of the clamp assembly 3. FIG. 3 shows how this embodiment of the clamp assembly 3 is formed of three die carriers 8 which are joined by clevises 15 and bolts 20. However, other embodiments of clamp assembly 3 could potentially be formed of two die carriers 8, four die carriers 8, or conceivably more than four die carriers 8. The die carriers may also sometimes be referred to as "jaw members" or simply "jaws." The joining of the die carriers 8 with the clevises 15 and bolts 20 creates an enclosed area or central passage 29 capable of receiving a tubular member.

As best seen in FIG. 5, the basic body of die carrier 8 will include clevis ears 11 with pin apertures 12 formed there through. On the side of the die carrier body opposite clevis ears 11 is the carrier bolt bore 24. Carrier bolt bore 24 has a diameter sized to allow the passage of the threaded shaft of bolt 20, but not its head 21. The rear access bore 28 seen in FIG. 3 is large enough to accommodate bolt head 21. The front central section of the die carrier body will have the die insert slot 9 and the retaining screw aperture 10. In the assembled state seen in FIG. 4, the clevis 15 is secured to the die carrier body by the clevis pin aperture 17 being positioned between clevis ears 11 and clevis pin 13 being inserted therebetween and secured in place with pin retainer 14. Similarly, the carrier bolt 20 will extend through bolt bore 24 with a lock washer 26 positioned in front of bolt head 21 and an internal retaining ring 22 following bolt head 21 in rear access bore 28. Retaining ring 22 will act to prevent carrier bolt 20 from falling out of the rear access bore while the multiple die carriers 8 are connected into the clamp assembly 3. In one embodiment, carrier bolt 20 is a torque indicating bolt such as a MaxBolt™ load indicating fastener available from Valley Forge & Bolt Mfg. Co., of Phoenix, Ariz.

The die insert 30 will be secured in die slot 9 with retaining plate or clip 31 being engaged by die retaining screw 33 advancing into screw aperture 10 (with lock-ring washer 32 between the retaining screw head and retaining plate 31). As is well known in the art, die insert 30 will have a curved face which matches of the curvature of the tubular member diameter die insert 30 is sized to grip. The front face of die insert 3 will typically be modified to grip the tubular member with minimum slipping. For example, the die insert face may have a conventional knurled tooth pattern, a granular particle surface, or one of many other die surface patterns known in the art.

Viewing again FIG. 3, it may be seen how the threaded shaft of carrier bolt 20 will engage the internally threaded aperture 16 of clevis 15. The carrier bolt 20 of each die carrier 8 will engage the clevis 15 of an adjacent die carrier 8, ultimately forming the closed ring configuration of the clamp assembly 3. The spacer 23 on the shaft of carrier bolt 20 will be sized to limit the degree which bolt head 21 can move backward in bolt bore 24 and maintain the approximate spacing of the die carriers from one another in order that a tubular of intended diameter can be position through the central passage 29 of clamp assembly 3. However, it will be understood that the bolt head 21 is capable of a small degree of translational movement (i.e., in a direction along the centerline of the bolt) within bolt bore 25 between a front shoulder of bolt bore 25 and the internal retaining ring 22. This allows the clamp assembly's central passage to initially be large enough for the first tubular to pass between the die insert faces and then for the dies carriers to move inward sufficiently for the die insert faces to firmly engage the tubular. Although largely hidden from view in FIGS. 3 to 5, the lower surface of die carriers 8 will include a triangular boss 35 which is better seen in FIG. 8 and whose function will be described in more detail below.

Figure 6:
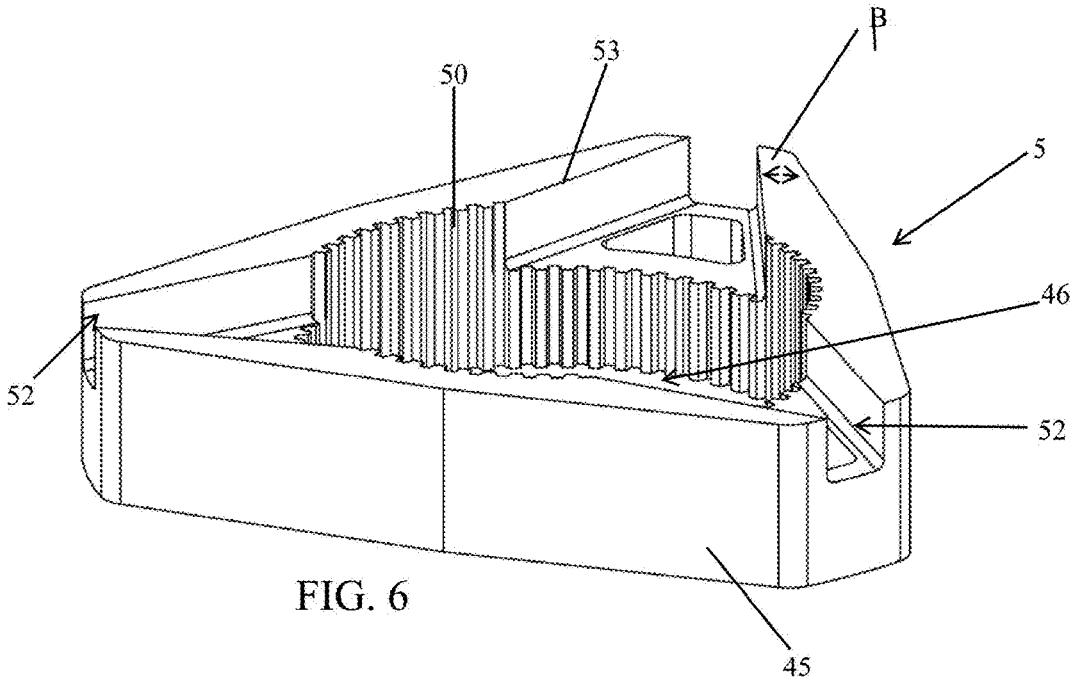
FIG. 6 is a perspective view of one embodiment of the stop ring.

FIG. 6 illustrates the other main component of tool joint clamp 100, stop ring 5, which may also sometimes be referred to as the "spline ring" or "splined stop ring." In the illustrated embodiment, stop ring 5 has a generally triangular shape along its external sidewalls 45. Similar to clamp assembly 3, stop ring 5 has a central passage 46 sized to engage the second tubular member of the connection on which the tool joint clamp is positioned. The internal wall of the central passage is further lined with splines 50 running parallel to the direction of central passage 46. Formed at the corners of stop ring 5 are the boss slots 52. Boss slots 52 extend through the upper portion of the external walls 45 into the central passage 46. It can be seen that boss slots 52 are substantially triangular in shape with the straight line side walls 53 forming an angle β if extended to their intersecting point (as suggested by the dashed lines in FIG. 6). This angle β may vary considerably from embodiment to embodiment, for example between 2.5° and 80°. In a preferred embodiment seen in FIG. 6, β is approximately 45°. It will also be noted that the portions of the internal sidewall forming central passage 46 will have longer splines 50 than the sidewall portions below boss slots 52. Although FIG. 6 shows three boss slots, it will be understood that the number of boss slots is not critical and generally will follow the number of die carriers forming the clamp assembly 3. While also not critical, it can be seen the FIG. 6 embodiment of stop ring 5 is formed of a continuous section of material, not as an assembly of parts as clamp assembly 3. Forming stop ring 5 of a continuous section of material is often advantageous when the stop ring incorporates cam surfaces such as provided by the boss slots.

Figure 7:
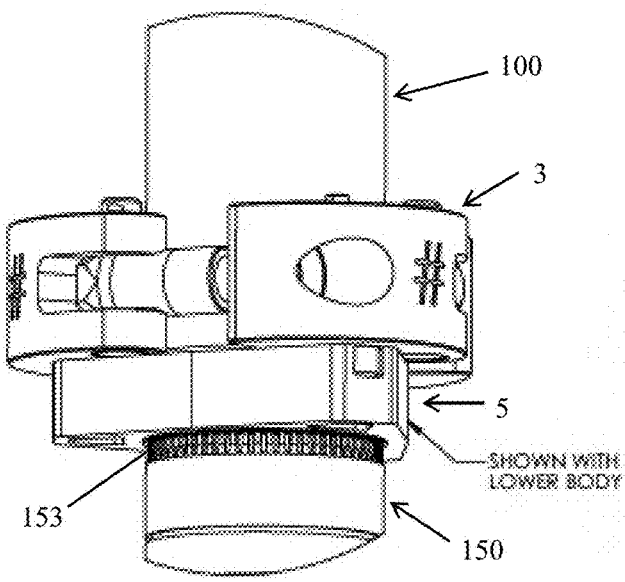
FIG. 7 is a more detailed view of the tool joint clamp engaging made up tubular members.
Figure 8:
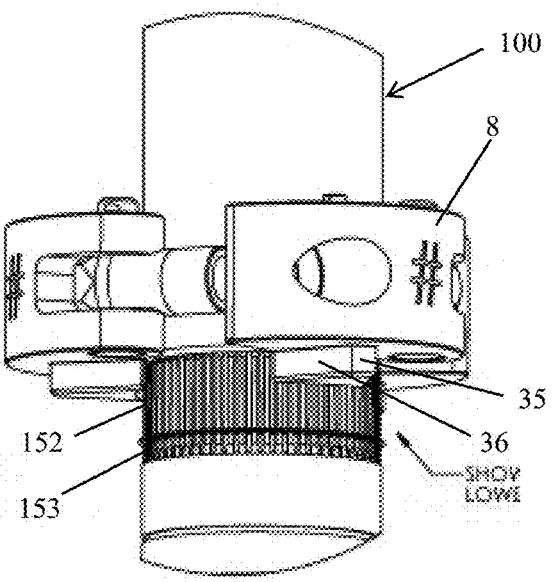
FIG. 8 is the view of FIG. 7, but with the stop ring removed.
Figure 9:
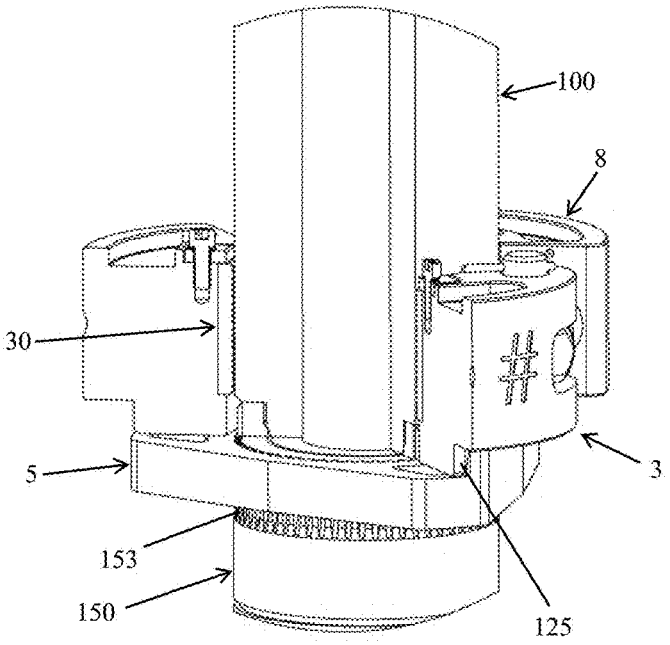
FIG. 9 illustrates a partial sectional view of the tool joint clamp engaging coupled tubulars.
Figure 10:
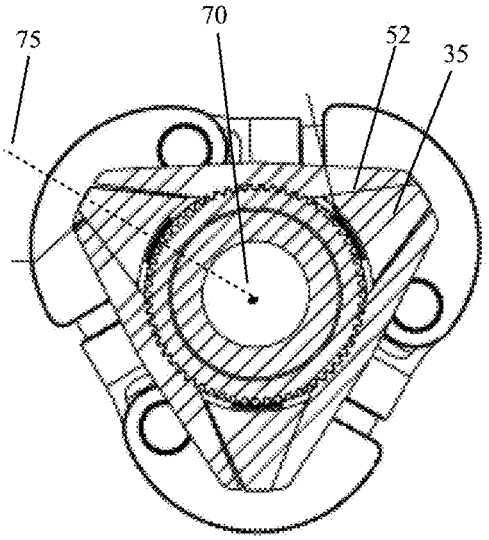
FIG. 10 is a cross-sectional view taken through the stop ring.

FIGS. 7 to 9 better illustrate how the tool joint clamp 1 will engage the connection of quill 100 and valve body 150. The internal splines 50 on stop ring 5 will engage the external splines 152 on valve body 150. As best seen in FIG. 8 (showing stop ring 5 removed), valve body 150 will include an increased diameter 153 at the base of external splines 152 on which stop ring 5 will come to rest after sliding over external splines 152. It will be understood that the engagement of internal splines 50 with external splines 152 prevents any relative rotation between stop ring 5 and valve body 150. As suggested above, the location of bosses 35 on a lower surface of die carriers 8 is clearly seen in FIG. 8. As seen in FIG. 10, the bosses are substantially triangular in the sense that they are essentially a triangle with a curved base and a truncated apex.

Figure 11:
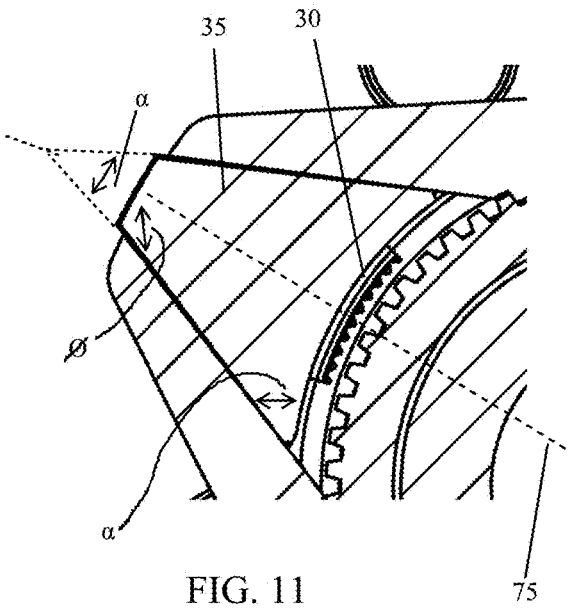
FIG. 11 is an enlarged view of the boss and boss slot in an unengaged state.
Figure 12:
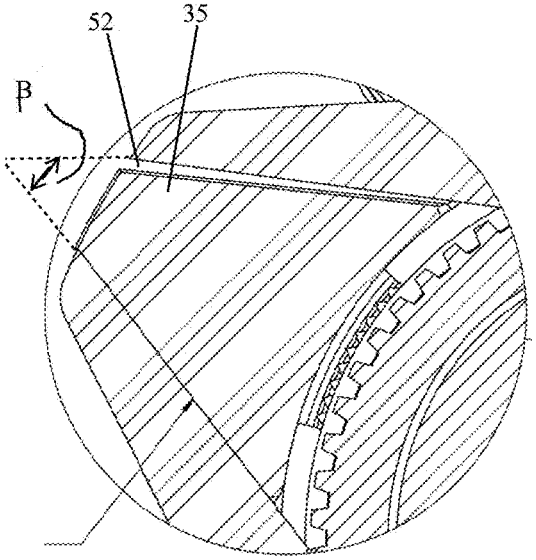
FIG. 12 is an enlarged view of the boss and boss slot in an engaged state.
Figure 13:
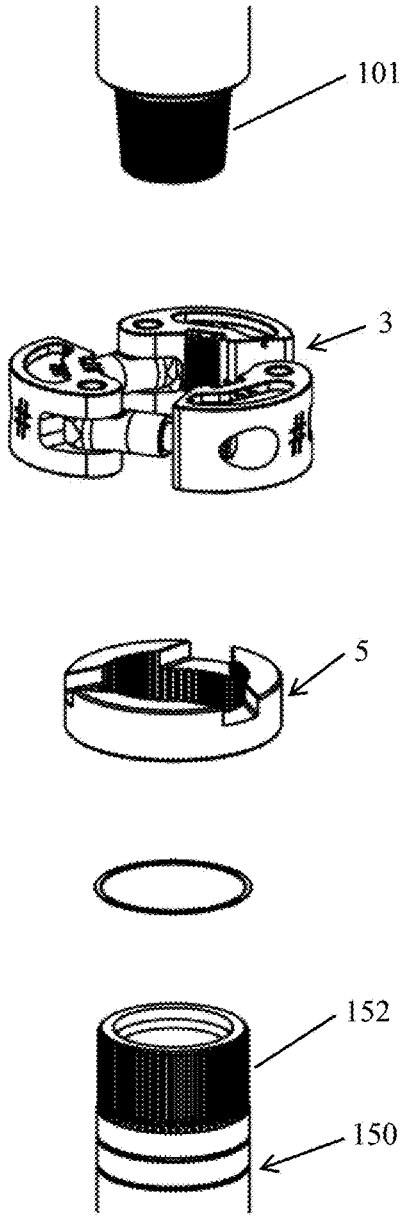
FIG. 13 is an exploded view of another embodiment of the clamp assembly and stop ring.

FIGS. 10 to 12 best illustrate the interaction between bosses 35 and boss slots 52. FIG. 10 is a cross-sectional view taken at the section line Y-Y seen in FIG. 1. FIG. 10 shows the vertical centerline 70 of the tool joint clamp, which is also the vertical centerline of clamp assembly 3 and stop ring 5. FIG. 10 further shows the radial axis 75 extending from the die carrier (or boss) center to tool centerline 70. FIG. 11 illustrates an enlarged view of boss 35 and boss slot 52. FIG. 11 shows boss 35 position rearward in boss slot 56 such that die insert 30 is not engaging the tubular surface. FIG. 11 also shows the angle formed by the boss sidewalls 36, i.e., angle $\alpha$. FIG. 12 similarly shows the boss slot angle $\beta$, which will generally be slightly larger than $\alpha$. In many embodiments, $\beta$ is between 1° and 10° larger than $\alpha$ and in preferred embodiments, $\beta$ is between 1° and 3° larger than $\alpha$. This difference in angles will contribute to the "cam effect" described below between boss 35 and boss slot 52.

To mount tool joint clamp 1 over the connection between quill 100 and valve 150, prior to the connection being made, the spiral retaining ring 154 and then stop ring 5 are lowered over the external splines 152 on valve 150 such that the internal stop ring splines 50 engage the external splines 152. Spiral retaining ring 154 will act as a spacer to prevent the bottom of stop ring 5 from directly resting on the shoulder where external splines 152 terminate on valve 150. Next, the assembled clamp assembly 3 can be slid over and positioned above the pin threads 101 on quill 100, allowing the pin threads 101 to then engage the box threads 151 on valve 150, after which the quill/valve connection is made up to its specified torque load (e.g., 40,000 ft-lbs). Alternatively, the quill/valve connection could be made up prior to positioning clamp assembly 3 on quill 100. In this alternative, clamp assembly 3 would be partially disassembled (e.g., by removing a clevis pin), thereby allowing the clamp assembly 3 to be "opened up" and "wrapped around" quill 100 before being reassembled in its closed ring configuration by reinsertion of the clevis pin.

Once the quill/valve connection is made up and claim assembly 3 is positioned around quill 100, clamp assembly 3 is moved onto the stop ring 5 such that bosses 35 engage boss slots 52. Thereafter, the carrier bolts are gradually and sequentially tightened to draw the die carriers 8 together in order to have the die inserts place an initial radial load on quill 100. In one example, the carrier bolts are tightened to about 1000 ft-lbs, placing an initial radial force between each die insert and quill 100.

After this assembly procedure, the tool joint clamp 1 is in its assembled state as suggested in FIG. 10. The connection 125 between quill 100 and valve 150 has been made up and torqued to a predetermined load. Stop ring 5 is engaging external spines 152 on valve 150 and die inserts 30 are engaging quill 100. The bosses 35 on die carriers 8 are positioned rearward in the boss slots 52 as suggested by FIG. 11. During normal drilling operations, a top drive will transfer torque through the quill 100, valve 150 (and possibly other tubulars not illustrated such as a sub-saver) to the tubular being worked into the wellbore, e.g., a stand of drill pipe attached to the drill string already in the wellbore. Where the drill string provides substantial resistance to being rotated, that torque would normally (i.e., in the absence of the tool joint clamp) be transferred through quill 100 to the connection 125, introducing an undesirable additional torque tending to tighten connection 125, or additional torque tending to loosen connection 125 (depending on the direction of rotation). However, because in the FIG. 10 embodiment, quill 100 transfers torque to die carriers 8, then through bosses 35 to stop ring 5, and finally from stop ring 5 to external splines 152 on valve 150, connection 125 does not experience any additional torque load.

Most significantly, when die carriers 8 initially receive a torque load from quill 100, die carriers 8 will urge bosses 35 into active engagement with boss slots 52. This causes the sidewall 36 (acting as a cam follower) of bosses 35 to engage the slightly larger angled sidewall 53 (acting as a cam surface) of boss slots 52. This will cause a camming action whereby the torque acting on the die carriers will be transferred into a radial force acting in the direction of the centerline of the clamp assembly 3, thus increasing the gripping load applied by the die inserts 30. Those skilled in the art will grasp that the greater the differential torque load applied between quill 100 and valve 150, the greater the radial gripping force applied by die inserts 30 onto quill 100.

In the FIG. 11 embodiment, the bosses 35 (and boss slots 52) are generally symmetrical around the radial axis 75 which extends through the bosses and boss slots. For example, the angles $\phi$ and $\gamma$ on the bosses 35 are the same on opposing sides of the radial axis 75, as are the corresponding angles on the boss slots. This symmetry around radial axis 75 results in equal torque-to-radial-force ratios regardless of whether clockwise or counter-clockwise torque is exerted on the clamp assembly.

It will be clear that the cam surface (boss slot sidewall 53) is configured to urge the die carriers toward the clamp assembly's centerline when relative torque is applied between the clamp assembly and the stop ring. Naturally, other cam surface/cam follower configurations could be employed in place of the illustrated triangular boss/boss slot structure. For example, some type of roller cam follower could act against a arcuate cam surface.

Figure 14:
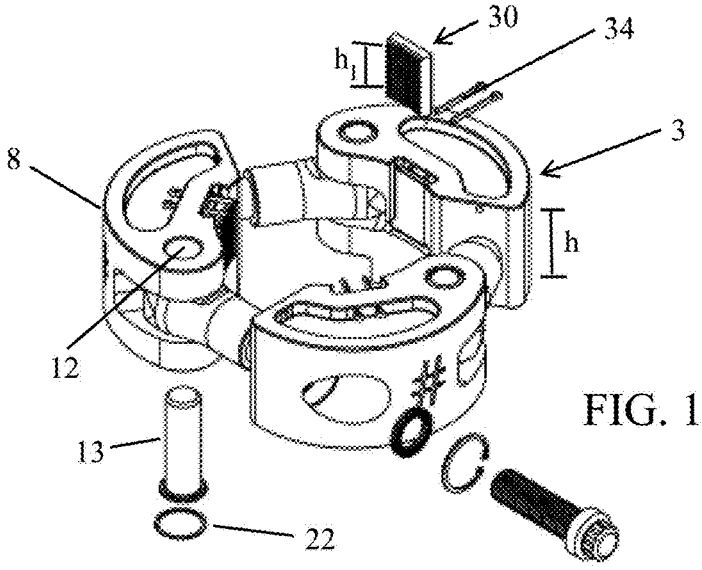
FIG. 14 is a perspective view of the clamp assembly of FIG. 13.
Figure 15:
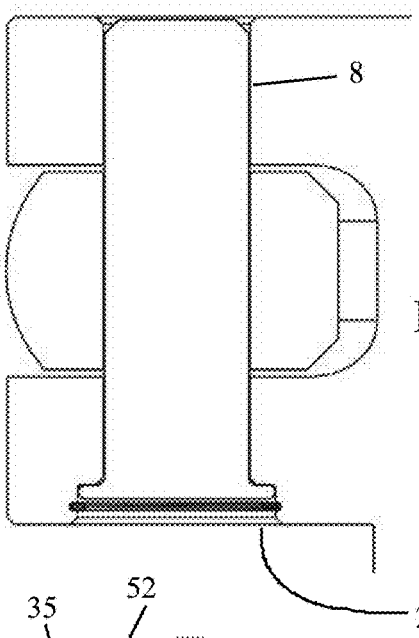
FIG. 15 is a sectional view of the internally retained clevis pin.
Figure 16:
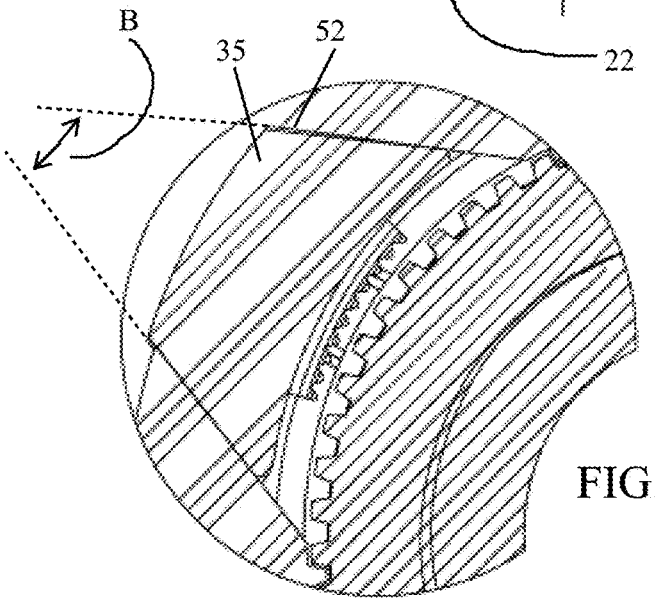
FIG. 16 is a sectional view of the boss and boss slot of the FIG. 13 embodiment.

FIGS. 13 to 16 illustrate an alternative embodiment of the tool joint clamp. The most notable change in the FIG. 13 embodiment is the stop ring 5, which is now circular in shape rather than triangular as seen in the FIG. 1 embodiment. As best seen in FIG. 16, boss 35 and boss slot 52 of this embodiment are essentially truncated triangles similar to that seen in FIG. 10. However, the boss 35 in FIG. 16 has both a curved base and a curved truncated opposite side, with the curved opposite side generally conforming to the curvature of the stop ring outer circumference. B for the FIG. 16 embodiment is generally the same as described above for the FIG. 12 embodiment.

The FIG. 14 clamp assembly 3 illustrates a few modifications from that seen in FIGS. 1-12. Typically, the height "h" of the die carriers 8 is someone less than in earlier embodiments and will accommodate die members 30 having a height of "h1" between about 2.5" and about 3". Additionally, the die members 30 will be retained in the die slots by cotter pins 34 extending through apertures at the top of the die slots. Further, the clevis pins 13 will be completely recessed in pin apertures 12. As seen in FIG. 15, the internal retaining rings 22 engage an internal ring groove in order to hold the head of clevis pins 13 within the pin apertures 12. The term "about" will typically mean a numerical value which is approximate and whose small variation would not significantly affect the practice of the disclosed embodiments. Where a numerical limitation is used, unless indicated otherwise by the context, "about" means the numerical value can vary by +/−5%, +/−10%, or in certain embodiments +/−15%, or even possibly as much as +/−20%. Similarly, "substantially" will typically mean at least 85% to 99% of the characteristic modified by the term. For example, "substantially all" will mean at least 85%, at least 90%, or at least 95%, etc. Although the invention had been described in terms of certain specific embodiments illustrated in the drawings, those skilled in the art will see many obvious modification and variations which are intended to be encompassed by the scope of the following claims.

The invention claimed is:

1. A tubular connection reinforced with a joint clamp, the tubular connection comprising:

(a) a first tubular with pin threads engaging a second tubular with box threads, the second tubular including external splines on an end of the second tubular having the box threads;

(b) a clamp assembly including at least two die carriers engaging the first tubular, each die carrier having a translating and pivoting link between the die carriers such that the die carriers may move toward and away from a centerline of the clamp assembly;

(c) a stop ring including a ring body having a central aperture forming an internal sidewall, at least a portion of the internal sidewall having splines, wherein the splines of the stop ring engage the splines of the second tubular; and (d) a cam surface and cam follower positioned between the clamp assembly and the stop ring, the cam surface and cam follower configured to urge the die carriers toward the first tubular when relative torque is applied between the clamp assembly and the stop ring.

2. The tool joint clamp of claim 1, wherein the cam surface is positioned on the stop ring and the cam follower is positioned on the die carriers.

3. The tool joint clamp of claim 2, wherein the cam follower are bosses positioned on the die carriers.

4. The tool joint clamp of claim 3, wherein the bosses are substantially triangular projections integrally formed on a face of the die carriers which abut the stop ring.

5. The tool joint clamp of claim 1, wherein the cam follower comprises bosses and the cam surface comprises boss slots and wherein the bosses and boss slots are symmetrical around a radial axis extending through the bosses and boss slots.

6. The tool joint clamp of claim 5, wherein the boss slots comprise straight line walls forming an angle of between 5° and 80°.

7. The tool joint clamp of claim 6, wherein the bosses comprise straight line walls forming an angle 1° to 10° degrees less that the angle of the boss slot walls.

8. A method of reinforcing a tubular connection with a joint clamp comprising the steps of:

(a) positioning a stop ring on a second tubular having external splines, the stop ring including a ring body having a central aperture forming an internal sidewall, at least a portion of the internal sidewall having internal splines, wherein the internal splines of the stop ring engage the external splines of the second tubular (b) positioning on a first tubular a clamp assembly, the clamp assembly including at least two die carriers, each die carrier having a translating and pivoting link between the die carriers such that the die carriers may move toward and away from a centerline of the clamp assembly;

(c) threading together the first and second tubular members;

(d) engaging the clamp assembly with the stop ring such that a cam surface and cam follower are positioned between the clamp assembly and the stop ring, the cam surface and cam follower configured to cause the die carriers to impart an increased radial force on the first tubular when relative torque is applied between the clamp assembly and the stop ring; and (e) closing the clamp assembly such that the die carriers engage the first tubular with an initial radial force.

9. The method of claim 8, wherein step (b) is performed prior to step (c).

10. The method of claim 8, wherein step (c) is performed prior to step (b).

11. The method of claim 8, wherein the cam surface is positioned on the stop ring and the cam follower is positioned on the die carriers.

12. The method of claim 11, wherein the cam follower are bosses positioned on the die carriers.

13. The method of claim 12, wherein the bosses are substantially triangular projections integrally formed on a face of the die carriers which abut the stop ring.

14. The method of claim 13, wherein boss slots formed in the stop ring comprise straight line walls forming an angle of between 5° and 80°.

15. The method of claim 14, wherein the bosses comprise straight line walls forming an angle 1° to 10° degrees less that the angle of the boss slot walls.

16. The method of claim 14, wherein the bosses and boss slots are symmetrical around a radial axis extending through the bosses and boss slots.

17. The method of claim 8, wherein the stop ring is substantially circular.

18. A tool joint clamp comprising:

(a) a clamp assembly including at least two die carriers, each die carrier having:

(i) at least one die insert;

(ii) a translating and pivoting link between the die carriers such that the die carriers may move toward and away from a centerline of the clamp assembly;

(iii) a boss extending from the die carriers, the boss being substantially triangular and having straight line walls forming an angle of between 5° and 80°;

(b) a stop ring including:

(i) a ring body having a central passage forming an internal sidewall, at least a portion of the internal sidewall having splines;

(ii) boss slots sized to receive the bosses on the die carriers, the boss slots having sidewalls forming an angle 1° to 10° degrees greater that the angle of the boss walls;

(c) a cam surface formed on the boss slot sidewalls, the cam surface configured to urge the die carriers toward the clamp assembly's centerline when relative torque is applied between the clamp assembly and the stop ring.

19. The tool joint clamp of claim 18, wherein the boss slots are formed through the internal sidewall of the stop ring.

20. The tool joint clamp of claim 18, wherein portions of the sidewall between the boss slots have longer sets of splines.

* * * * *